United States Patent [19]

Komai et al.

[11] Patent Number: 4,941,015

[45] Date of Patent: Jul. 10, 1990

[54] DEVICE FOR SCREENING A PHOTOCONDUCTIVE ELEMENT UNIT FROM EXTERNAL LIGHT

[75] Inventors: Hiroshi Komai; Hideo Aoki, both of Yokohama, Japan

[73] Assignee: Ricoh Compnay, Ltd., Tokyo, Japan

[21] Appl. No.: 289,240

[22] Filed: Dec. 23, 1988

[30] Foreign Application Priority Data

Dec. 24, 1987 [JP] Japan ..... 62-194780 [U]
Jul. 28, 1988 [JP] Japan ..... 63-99065[U]

[51] Int. Cl.[5] ..... G03G 15/00

[52] U.S. Cl. ..... 355/200; 346/145; 346/160; 346/160.1; 355/210; 355/212; 355/215

[58] Field of Search ..... 355/210, 200, 215, 212, 355/214; 346/145, 160, 160.1

[56] References Cited

U.S. PATENT DOCUMENTS 4,588,280 5/1986 Ogawa et al. ..... 355/200

FOREIGN PATENT DOCUMENTS 62-81651 4/1987 Japan ..... 355/215

*Primary Examiner*—R. L. Moses
*Assistant Examiner*—Susan D. Luddy
*Attorney, Agent, or Firm*—Oblon, Spivak, McClelland, Maier, & Neustadt

[57] ABSTRACT

In a laser printer or similar electrophotographic image recorder of the type having a photoconductive element subunit including a photoconductive drum and an upper and a lower unit which are hinged together and each is loaded with a different group of structural parts and elements inclusive of the subunit, a device for screening the drum includes a screening member which is movable in interlocked relation to opening and closing motions of the upper unit. The screening member covers the drum when the upper unit is opened and uncovers it when the upper unit is closed. When the image recorder is in operation with the upper unit being closed, the drum is uncovered to allow a laser beam to reach the drum. When the image recorder is out of operation with the upper unit being opened, the screening member covers the drum in response to an opening motion of the upper unit so as to screen the drum against external light.

5 Claims, 6 Drawing Sheets

DEVICE FOR SCREENING A PHOTOCONDUCTIVE ELEMENT UNIT FROM EXTERNAL LIGHT

BACKGROUND OF THE INVENTION

The present invention relates to an electrophotographic image recorder having an upper and a lower unit which are openably hinged to each other and, more particularly, to a device for screening a photoconductive element unit of such an image recorder against external light when the upper unit is opened away from the lower unit.

Many modern copiers, laser printers, facsimile apparatuses and other electrophotographic image recorders are made up of an upper and a lower unit each being loaded with a different group of structural parts and elements. When the upper unit of this kind of image recorder is opened upward away from the lower unit for the purpose of supplying toner, or developer, or removing a jamming sheet, for example, various parts and elements of the image recorder, especially a photoconductive drum of a photoconductive element unit, is exposed to the outside. It is known that a photoconductive drum is susceptible to external light, i.e., the performance of the drum is degraded when its surface is continuously exposed to external light. Therefore, a problem with the image recorder having an upper unit which is openable away from the lower unit is that the photoconductive drum is directly exposed to external light that deteriorates the drum.

SUMMARY OF THE INVENTION

It is therefore an object of the present invention to provide a device applicable to an image recorder of the type having an upper and a lower unit openable away from each other and a photoconductive element unit including a photoconductive drum, for preventing the drum from being exposed external radiations which would degrade the performance of the drum.

In a device for use in an electrophotographic image recorder having an upper and a lower unit openably hinged to each other and each being loaded with a different group of structural parts and elements inclusive of a photoconductive element unit having a photoconductive drum, for screening the photoconductive element unit against external light, the device being provided with a screening member, in accordance with the present invention, the screening member is movable in an interlocked relation with the opening and closing motions of the upper unit such that the drum is covered by the screening member when the upper unit is open and uncovered when the upper unit is closed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
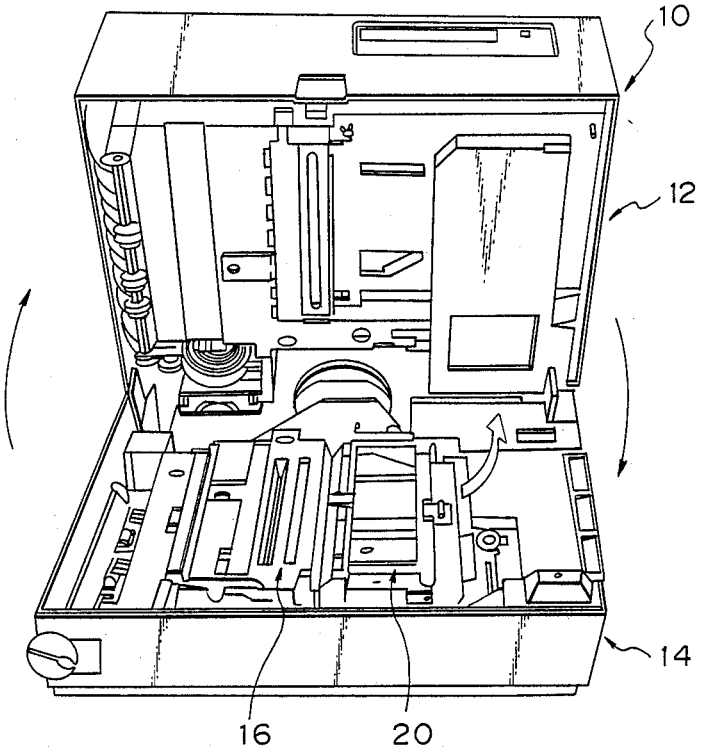
FIG. 1 is a perspective view showing a laser printer which is an example of image recorders, an upper unit of the printer being shown in an open position away from a lower unit.

Referring to FIG. 1 of the drawings, a laser printer representative of a family of electrophotographic image recorders is shown and generally designated by the reference numeral 10. The laser printer 10 is generally made up of an upper unit 12 and a lower unit 14 each being loaded with particular structural parts and elements. The upper unit 12 is openable away from the lower unit 14, as illustrated. Mounted on the lower unit 14 are a photoconductive element unit 16 which includes a photoconductive element in the form of a drum 18 (FIG. 2), a developing device 20 located close to the unit 16, ect. By opening the upper unit 12 upward as illustrated, a person can supply toner or remove a jamming sheet as desired.

Figure 2:
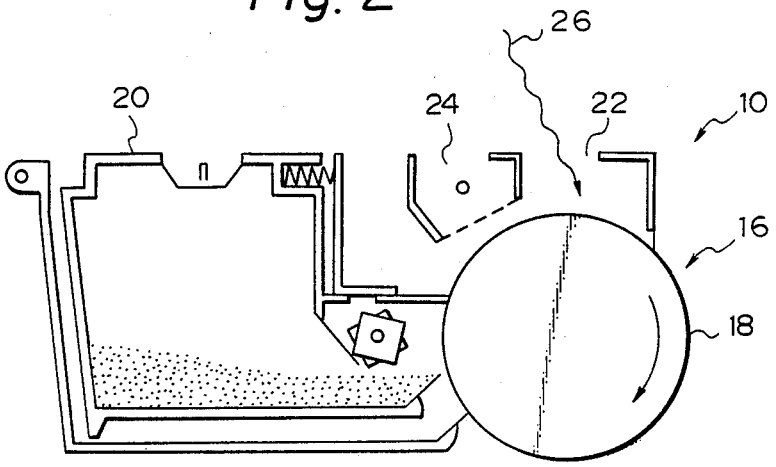
FIG. 2 is a sectional side elevation showing an arrangement of a photoconductive element unit and a developing device which are installed in the printer of FIG. 1.

FIG. 2 shows the photoconductive element unit 16 and the developing device 20 which are mounted on the lower unit 14.

As shown, the photoconductive element unit 16 is provided with an opening 22 above the drum 18. The reference numeral 24 designates a charger. Laser optics, not shown, writes an image representative of a document on the surface of the drum 18, and then the developing device 20 develops the image on the drum 18. As long as the laser printer 10 is in operation, the upper unit 12 and therefore the opening 22 is kept closed so that the drum 18 of the unit 16 is screened against harmful external radiations. However, when the upper unit 12 is opened away from the lower unit 14 for supplying toner or removing a jamming sheet, for example, the opening 22 is uncovered to external light 26 into the unit 16 to illuminate the surface of the drum 18. The light 26, therefore, causes the surface of the drum 18 to deteriorate.

A device for screening a photoconductive element unit against external radiations in accordance with the present invention will be described in detail with reference to FIGS. 3 to 9. In the figures, the same or similar structural parts and elements as those shown in FIGS. 1 and 2 are designated by like reference numerals.

Figure 3:
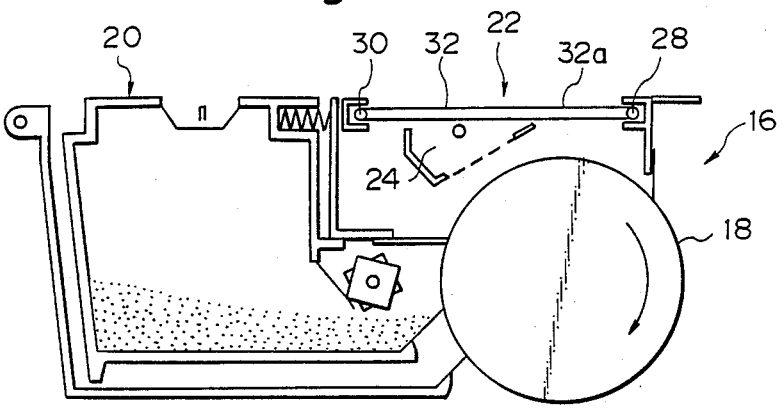
FIG. 3 is a sectional side elevation showing an arrangement of a photoconductive element unit and a developing device included in an image recorder to which a preferred embodiment of the present invention is applied.

Referring to FIG. 3, a photoconductive element unit or subunit 16 and a developing device 20 representative of a preferred embodiment of the present invention are shown in a sectional side elevation. In the figure, and endless movable belt 32 is disposed in an opening 22 which is formed above a photoconductive drum 18. The belt 32 is passed over rollers 28 and 30 and driven by one of the latter. Slits 32a are formed through the belt 32 for passing a laser beam therethrough. As shown in detail in FIGS. 4A to 4D, each slit 32a has a length and a width d, i.e., size which is great enough for a laser beam 34 to scan the drum 18 in the main scanning direction.

Figure 5A:
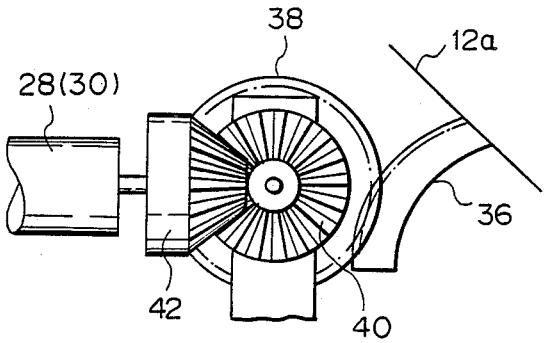
FIG. 5A and 5B are views showing a specific construction of a mechanism for driving the belt of FIG. 3.
Figure 5B:
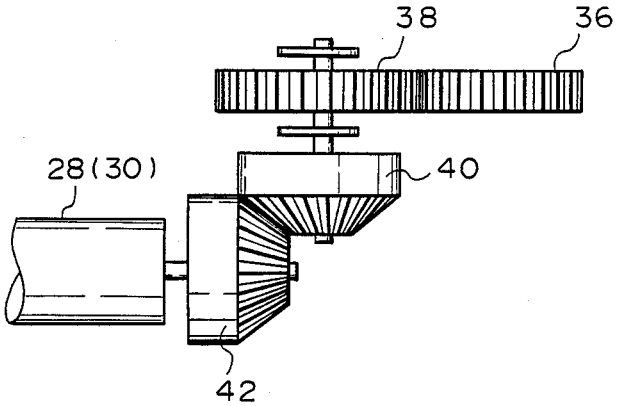

FIGS. 5A and 5B show a specific construction of a mechanism for driving the belt 32. As shown, a rack 36 is provided on the bottom 12a of the upper unit 12 and constantly meshed with a pinion 38 so that moving the upper unit 12 up and down may cause the pinion 38 to rotate. A bevel gear 40 is provided coaxially with the pinion 38 and held in constant mesh with another bevel gear 42 which is in turn coaxial with the roller 28 or 30 adapted to drive the belt 32. In this configuration, when the upper unit 12 is opened or closed, the rack 36 provided on the upper unit 12 rotates the pinion 38 and thereby the roller 28 or 30 via the bevel gears 40 and 42. In this instance, driving only one of the rollers 28 and 30 in a rotary motion suffices.

Figure 4A:
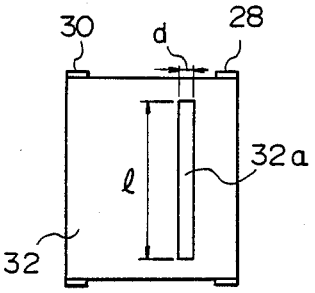
FIG. 4A to 4D are schematic views illustrating relative positions of a movable belt and a photoconductive drum of the image recorder shown FIG. 3 which are set up in a closed and an open position of an upper unit of the image recorder, respectively.
Figure 4C:
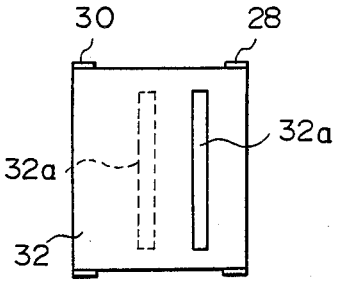
Figure 4B:
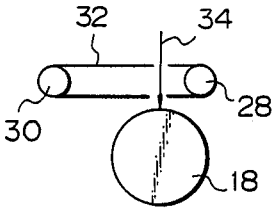
Figure 4D:
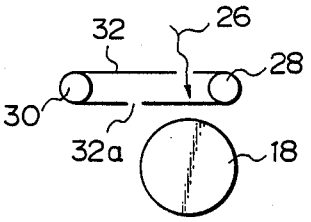

FIGS. 4A and 4B, a relative position of the slits 32a formed through the belt 32 is shown which is set up when the upper unit 12 is closed. FIGS. 4C and 4D show a relative position of the slits 32a which occurs when the upper unit 12 is opened. The correspondence of the slits 32a and the drum 18 will be best understood from FIGS. 4B and 4D. Specifically, the slits 32a are positioned such that in the closed position of the upper unit 12 (FIGS. 4A and 4B) a laser beam 34 is allowed to reach the drum 18 via the slits 32a which are in alignment and, in the open position of the upper unit 12 (FIGS. 4C and 4D), the slits 32a are shifted out of alignment as represented by a phantom line in FIG. 4C to intercept external light. In the condition shown in FIGS. 4C and 4D, therefore, the drum 18 is screened by the belt 32 against external radiations.

Figure 6:
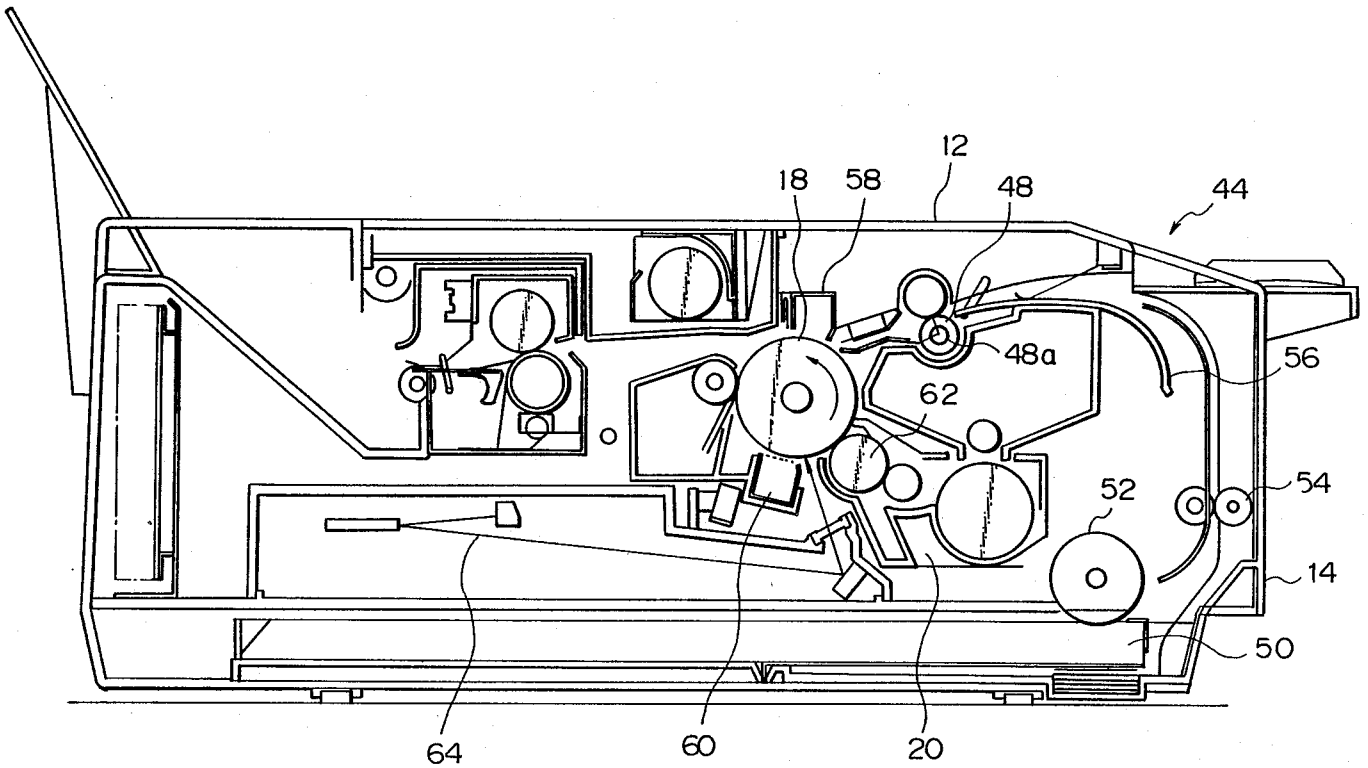
FIG. 6 is a sectional side elevation of an image recorder to which an alternative embodiment of the present invention is applied.
Figure 7:
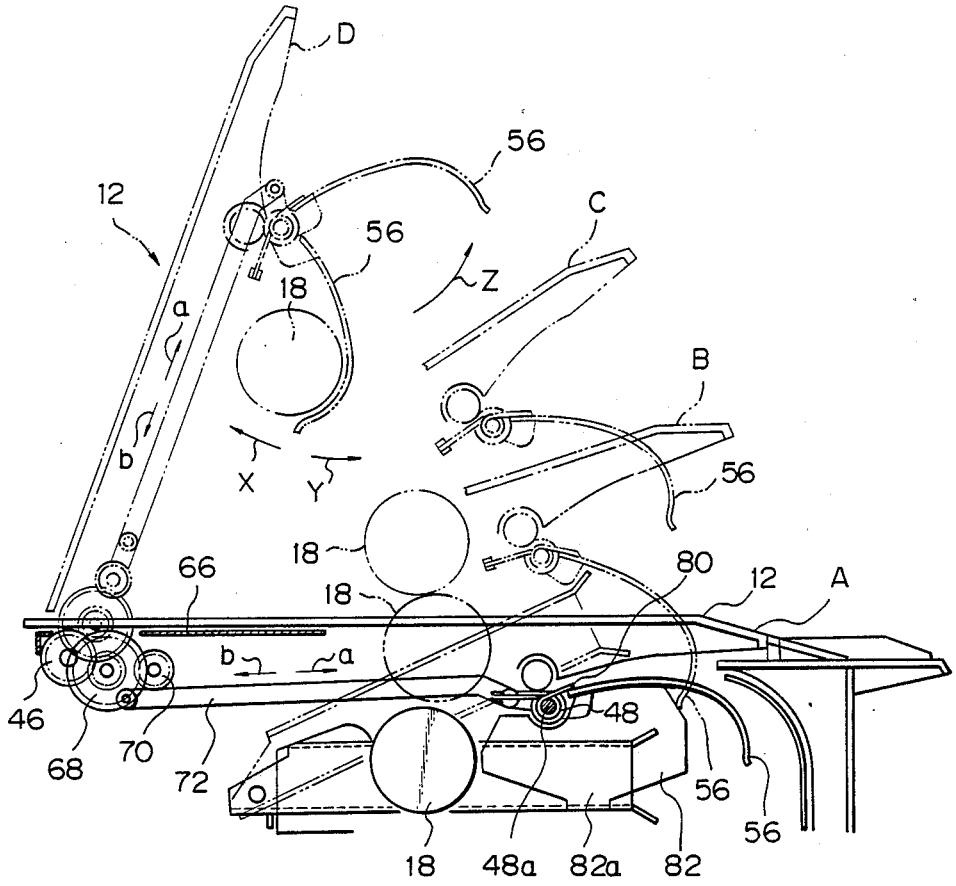
FIG. 7 is a view demonstrating the movements of the image recorder shown in FIG. 6.

Referring to FIG. 6, a laser printer 44 to which is implemented by an alternative embodiment of the present invention is shown. In the figure, the upper unit 12 and the lower unit 14 are shown in their closed position. As shown in FIG. 7, the upper unit 12 is rotatable about a hinge gear 46 between a position A and a position D. In this particular embodiment, the upper unit 12 is loaded with the drum 18, a register roller pair 48, etc.

As shown in FIG. 6, the printer 44 includes a sheet feeder 50 which is provided with a feed roller 54 for feeding paper sheets one by one toward a transport roller pair 54. The transport roller pair 54 drives the incoming paper sheet toward the register roller pair 48. A drum cover 56 associated with the drum 18 is rotatably mounted on a shaft 48a of the register roller pair 48 and guides the paper sheet toward the drum 18. Further shown in FIG. 6 are a transfer charger 58, a main charger 60, a developing roller 62, and laser optics 64.

Figure 8:
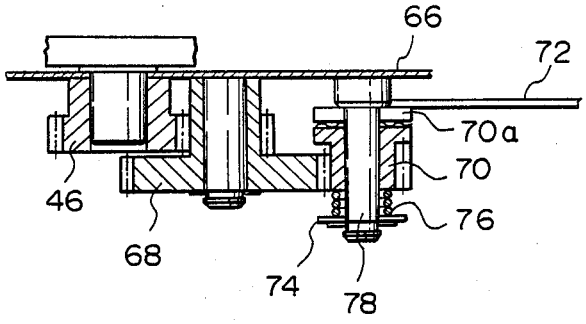
FIG. 8 is a section showing a hinged portion shown in FIG. 7.
Figure 9:
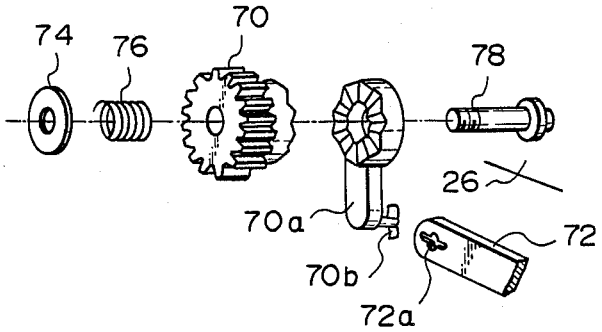
FIG. 9 is an exploded view of a slip spring included in the hinged portion of FIG. 8.

As shown in FIG. 7, the upper unit 12 and the lower unit 14 are hinged to each other by the hinge gear 46 which is mounted on an upper frame 66 which is in turn mounted on the underside of the upper unit 12, a stepped speed-up idler gear 68, and a slip ring gear 70. As shown in FIGS. 8 and 9, the slip ring gear 70 includes a slip ring 70a which is provided with a projection 70b. A link 72 is provided with an opening 72a in which the projection 70b is received. The other end of the link 72 is connected to the shaft 48a of the register roller pair 48. The slip ring 70a and slip ring gear 70 are coupled over a slip ring shaft 78 and constantly urged toward the upper frame 66 by a compression spring 76. A stop 76 is provided for preventing the spring 76 from slipping out of such a subassembly. A torsion spring 80 is wound around the register roller shaft 48a and securely retained at one end therof. The other end of the torsion spring 80 is abutted against the drum cover 56 which is rotatably mounted on the register roller shaft 48a, as stated earlier. Hence, the drum cover 56 is constantly biased downward by the spring 80 to remain in the position A shown in FIGS. 6 and 7. Designated by the reference numerals 82 and 82a are a toner box and a toner box holder, respectively.

In operation, as the upper unit 12 is moved away from the lower unit 14, i.e., from the position A toward the position D, the drum cover 56 begins rotating in a direction x about the register roller shaft 48a under the action of the torsion spring 80. At this instant, the link 72 is urged in a direction a by the slip ring mechanism 70, 72, 74, 76 and 78 of the hinged portion. As long as the force of the torsion spring 80 is effective, the rotating force of the gears 46 and 48 is cancelled by the above-mentioned slip ring mechanism and, hence, the drum cover 56 continuosly rotates along the back of the toner box 82 (position B). At the position C and the successive positions where the torsion spring 80 becomes ineffective, the link 72 is urged in the direction a by the gears 46 and 48 to in turn rotate the drum cover 56 in the direction x. The drum cover 56 continuously rotates in the direction x until the position D is reached. At the position D, the drum cover 56 is stopped by a stop, not shown, for thereby screening the drum 18 from external light.

When the upper unit 12 is moved from the position D toward the position A, the link 72 is pulled in a direction b by the gears 46 and 48 with the result that the drum cover 56 begins rotating in a direction y. At the position C, the torsion spring 80 interrupts the rotation of the drum cover 56 by playing the role of a stop. At the positions which follow the position C, the drum cover 56 is simply caused to idle by the slip ring mechanism of the hinged portion. The drum cover 56 continuosly moves downward while maintaining its position C, then abuts against the top of the toner box 82 with its tip, and then regains the position A while spreading the torsion spring 80. Although the link 72 tends to act in the direction b, it is caused to idle by the slip ring mechanism of the hinged portion.

In the position A, the drum cover 56 rest on the toner box 82 as illustrated, serving as a guide for a paper sheet.

The drum cover 56 may be raised by hand in a direction z to a position indicated by a dots-and-dash line for the purpose of replacing the drum 18. At this time, the drum cover 56 will be fixed in place at any position by the slip ring mechanism.

In summary, it will be seen that in accordance with the present invention a screening member is provided which screens a photoconductive drum against external light by being moved in interlocked relation to opening and closing motions of an upper unit, whereby the drum is protected against deterioration. Since the screening member is implemented as a movable belt formed with slits or as a drum cover which bifunctions as a paper guide, the drum can be screened without resorting to special manipulations.

Various modifications will become possible for those skilled in the art after receiving the teachings of the present disclosure without departing from the scope thereof.

What is claimed is:

1. In a device for use in an electrophotographic image recorder having upper and a lower unit openably hinged to each other and each being loated with a different group of structural parts and elements inclusive of a photoconductive element unit having a photoconductive drum, for screening said photoconductive element unit against external light, said device being provided with screening means, wherein said screening means is movable in interlocked relation to opening and closing motions of said upper unit such that said drum is covered by said screening means when said upper unit is open and is uncovered when said upper unit is closed, and wherein said photoconductive element unit comprises an opening provided above said drum, a belt member located to close said opening of said photoconductive element unit and formed with slit means for passing imagewise light to said drum therethrough, said belt member being moved, when said upper unit is opened, for changing a position of said slit means until said opening of said photoconductive element has been closed by said belt member.

2. A device as claimed in claim 1, wherein said photoconductive element unit is mounted on said lower unit.

3. A device as claimed in claim 5, wherein said photoconductive element unit is mounted on said upper unit.

4. A device as claimed in claim 3, wherein said image recorder comprises a register roller for a paper sheet which is transported toward said drum, said cover member being rotatable about a shaft of said register roller.

5. In a device for use in an electrophotographic image recorder having an upper and a lower unit openably hinged to each other and each being loaded with a different group of structural parts and elements inclusive of a photoconductive element unit having a photoconductive drum, for screening said photoconductive element unit against external light, said device being provided with screening means, wherein said screening means is movable in interlocked relation to opening closing motions of said upper unit such that said drum is covered by said screening means when said upper unit is open and is uncovered when said upper unit is closed, said screening means comprises a cover member rotatable about a shaft and covering a surface of said drum, and said cover member has a function of covering the surface of said drum when said upper unit is opened and a function of guiding the paper sheet being transported toward said drum when said upper unit is closed.

* * * * *